United States Patent [19]

Dittrich et al.

[11] 4,076,883

[45] Feb. 28, 1978

[54] FLAME-SPRAYABLE FLEXIBLE WIRES

[75] Inventors: Ferdinand J. Dittrich, Massapequa; John D. Weir, Huntington, both of N.Y.

[73] Assignee: Metco, Inc., Westbury, N.Y.

[21] Appl. No.: 600,741

[22] Filed: Jul. 30, 1975

[51] Int. Cl.[2] ..... B05D 7/00; B05D 3/08; B05D 1/08

[52] U.S. Cl. ..... 428/242; 427/221; 427/223; 427/423; 428/413; 428/425; 428/447; 428/448

[58] Field of Search ..... 427/34, 423, 221, 223; 428/379, 242, 413, 424, 425, 447, 448

[56] References Cited

U.S. PATENT DOCUMENTS

| | | | |
|---|---|---|---|
| 2,570,649 | 10/1951 | Davidoff | 106/193 |
| 2,875,043 | 2/1959 | Tour | 427/423 |
| 2,968,575 | 1/1961 | Mallonee | 106/287 |
| 3,148,173 | 9/1964 | Axelrood | 260/75 |
| 3,281,397 | 10/1966 | Axelrod | 260/77.5 |
| 3,294,724 | 12/1966 | Axelrood | 260/29.2 |
| 3,313,633 | 4/1967 | Longo | 427/423 |
| 3,322,515 | 5/1967 | Dittrich et al. | 427/423 |
| 3,410,817 | 10/1968 | McClellan et al. | 260/29.2 |
| 3,443,754 | 5/1969 | Charlop | 427/423 |
| 3,481,896 | 12/1969 | Logan | 260/38 |
| 3,607,343 | 9/1971 | Longo et al. | 427/423 |
| 3,617,358 | 11/1971 | Dittrich et al. | 427/423 |

FOREIGN PATENT DOCUMENTS 1,151,091 5/1969 United Kingdom.

OTHER PUBLICATIONS

Angewandte Chemie, 1970.

*Primary Examiner*—Michael R. Lusignan
*Attorney, Agent, or Firm*—Burgess, Dinklage & Sprung

[57] ABSTRACT

A flame-sprayable flexible wire comprising a mineral powder having a particle size of less than about 140 mesh and about 5 to 70% by volume of the wire of a polyurethane or epoxy polymer. Advantageously the wire is produced by forming the requisite mixture plus a curing agent, effecting a partial cure in a sheet form, crumbling the sheet to coarse granules and extruding the granules to form the wire. The mineral powder particles may first be coated with a surface active resin such as a silicone which promotes adhesion to the polymer and which protects the polymer from the degradative effect of the mineral. The preferred surface active resins are silicones. The wire retains its strength and flexibility over long periods of time and produces high quality flame sprayed surfaces.

26 Claims, No Drawings

FLAME-SPRAYABLE FLEXIBLE WIRES

This invention relates to flame-sprayable mineral powders in the form of flexible wires.

In the art of spraying heat-fusible materials, such as metals, plastics or the like, the material to be sprayed is fed in the form of a wire or rod into a melting zone. The advancing tip of the wire or rod is melted in this zone and the molten material is atomized by a blast of air or other gas, the atomized material being propelled by the air or gas blast onto the object to be coated. The spraying operation is usually performed with the aid of what is termed a spray gun of the wire feed type.

Many of the heat-fusible materials do not readily lend themselves to be sprayed in wire or rod form. Also many of these materials are not adapted to be fabricated into wire or rod form and thus are incapable of use in heat-fusible material spray guns of the wire feed type. Furthermore, certain heat-fusible materials as such are not sufficiently flexible to be made into wire that can be coiled. They are, for this reason, uneconomical in their application since they can then only be used in the form of relatively short lengths of wire or rod necessitating frequent interruption of the spraying operation in order to supply the gun with a new length of wire or rod whenever the preceding one is used up in the spraying operation. Also, certain heat-fusible materials and particularly a number of the metals or metal alloys can be fabricated only with difficulty in wire or rod form and only at considerable expense, rendering their use for spraying operations in a wire feed type spray gun relatively costly and uneconomical.

It is also sometimes desirable to spray certain mixtures of heat-fusible material with other agents as, for instance, mixtures of metal with refractory materials, metalloids, minerals or the like in order to obtain sprayed coatings of such mixtures. Wires or rods of heat-fusible material, however, are normally only available as unitary materials; for example in the case of metals they are available either in the form of the metal as such or in the form of its alloy or other metallurgically uniform product.

It has been proposed in the past to prepare composite wires of ordinarily non-drawable metals by the use of agglutinants, such as glue, rubber and benzol, water glass or dextrin. Composites of this type, however, are useful only in connection with the preparation of relatively thin decorative or corrosion protective coatings. The agglutinants give rise to the formation of decomposition products that are carried into the sprayed metal layer, contaminating the same to the point where they interfere with the strength and bonding characteristics of these coatings. Such type composites cannot be used for the application of spray metal coatings built up to any appreciable thickness, and particularly those used in the repair or rebuilding of machine elements in which considerable stresses and strains have to be borne by the applied spray metal. In addition to the aforementioned, it is therefore an important object of this invention to obtain a composite metal wire useful for spraying heat-fusible materials, and particularly metals, without impairing strength and bonding characteristics of the metal sprayed.

In many cases and particularly when applying certain hard facing spray metals, such as chromium-boron-nickel alloys, the applied spray metal coating is heated to obtain fusion thereof. In these cases it is particularly important that the applied spray metal coatings of these hard facing alloys are free from contaminating material.

In U.S. Pat. No. 3,481,896 it has been proposed to flame spray refractory oxides in rod form by mixing the oxide particles with a cross-linkable resin formulation, followed by extrusion into rods 2 feet in length and prolonged high temperature curing, e.g. 14 hours at 190° C. The resulting rods were rigid and, though flame sprayable, resulted in much manual handling in replacing rods. In addition, the sprayed material produced at the beginning and end of a rod differed from that in the middle, resulting in non-uniformly coated products.

An earlier proposal is described in U.S. Pat. No. 2,570,649 wherein the mineral powder is mixed with a plastic binder material and formed into a flexible wire; the preferred binders are polystyrene and polyethylene as well as solventsoluble collulose-based plastics. These thermoplastic materials melt below 120° C and clog the spray gun and thus do not permit continuous spraying to produce uniformly coated articles of high quality. The plastic softens and swells particularly when the gun is stopped temporarily; the wire feed cannot be restarted. Premature melting of the thermoplastic in the spraying wire tip results in dislodgement of large agglomerates which deposit undesirable plastic inclusions in the coating. Spray rate must be kept low to minimize these problems, resulting in inefficiency. Also deposit efficiency is low. These thermoplastics tend to become brittle with age, becoming too fragile to handle with the spraying apparatus.

In British Pat. No. 1,151,091 there are described flexible cords suitable for flame-spraying comprising a core formed of a paste comprising the desired mineral, a liquid and a binder, and a sheath formed from a second paste. This necessitates handling two different compositions and presents the possibility that the core may be improperly positioned relative to the sheath so that the wire may break or spraying may be non-uniform. Preparation of the composite is obviously complex.

It is accordingly an object of the present invention to provide a mineral powder in the form of a flame-sprayable flexible wire, which wire is inexpensive to produce and readily produces high quality uniform coatings without interruption and/or clogging of the spraying apparatus.

These and other objects and advantages are realized in accordance with the present invention pursuant to which there is provided a flame-sprayable flexible wire comprising a mineral powder having a particle size of less than about 140 mesh, and about 5 to 75% by volume of the wire, preferably about 15 to 70%, of a polyurethane or epoxy polymer. Advantageously the polymer does not melt, soften or decompose at temperatures below about 120° C, and consequently the wire does not prematurely melt in the barrel of the spraying device with attendant complications.

In accordance with a preferred feature of the invention, the mineral powder particles on their surfaces carry a layer of a surface active resin which is a polar molecule, one end of which is hydrophobic and the other hydrophilic, preferably a silicone resin, most preferably poly-methyl-and/or phenyl-siloxane, ranging from about 0.1 to about 15 and preferably from about 0.5 to 5 molecular thicknesses, based on the total surface area of powder particles as determined by the BET method. The surface active resin serves a dual purpose, i.e. it promotes adhesion between the powder particles and the polyurethane, epoxy or acrylic polymer and it protects the polymer from the undesirable catalytic effect thereon which often occurs when in intimate contact with inorganic mineral powders.

The invention also extends to the process whereby the flexible wire is formed, viz. by intimately mixing the mineral powder of indicated particle size with a thermoplastic polyurethane or epoxy polymer present in about 5 to 70% of the total volume of the mixture and desirably with a curing agent for converting the thermoplastic polymer to a thermoset polymer. The mixture is thereafter extruded under heat and pressure to produce an already cured flexible wire. When a surface active resin, i.e. a silicone, is also to be present, it is applied to the mineral powder prior to admixture with the polyurethane or epoxy or acrylic polymer.

In accordance with one process embodiment, the viscous mixture containing a curing agent, e.g. a cross-linking agent, prior to extrusion is formed into a sheet which is heated to cure the polyurethane or epoxy polymer at least in part, forming a solidified structure, preferably as a slab. This slab is thereafter crumbled to a coarse powder, each particle comprising a resinous structure having a multiplicity of original inorganic powder particles embedded in and bonded together by the polyurethane or epoxy and it is these coarse particles which are subjected to the extrusion. Surprisingly, not only do the pre-cured coarse particles stick together to form a wire, but the wire is flexible and readily sprayable.

The extrusion is done with a standard ram or screw extruder, at a pressure between about 1,000 and 15,000 psi, and a temperature between about 150° F and 550° F. The final wire size can be any diameter suitable for flame spraying, normally between about 20 B & S gauge (0.032 inches) and $\frac{3}{8}$ inches.

Flame spraying is accomplished with a standard wire type flame spray gun such as sold by Metco as Type 10 E..

Returning now to the mineral powder, it can be any of those described in U.S. Pat. No. 3,617,358, issued in the name of Ferdinand J. Dittrich on Nov. 2, 1971, the disclosure of which is incorporated herein by reference. These include, but are not limited to, the conventional metals, alloys or mixtures of metals used in this art as well as:

Oxides, as for example refractory oxides, such as alumina $Al_2O_3$, beryllia BeO, ceria $CeO_2$, chromia $Cr_2O_3$, cobalt oxide CoO, gallium oxide $Ga_2O_3$, hafnia $HfO_2$, magnesia MgO, nickel oxide NiO, tantalum oxide $Ta_2O_5$, thoria $ThO_2$, titania $TiO_2$, yttrium oxide $Y_2O_3$, zirconia $ZrO_2$, vanadium oxide $V_2O_5$, niobium oxide NbO, manganese oxide MnO, iron oxide $Fe_2O_3$, zinc oxice ZnO; complex aluminates such as $BaO . Al_2O_3$, i.e. $BaO . Al_2O_3$, $CeO . Al_2O_3$, $CoO . Al_2O_3$, $Gd_2O_3 . Al_2O_3$, $K_2O . Al_2O_3$, $Li_2O . Al_2O_3$, $0.5\ Al_2O_3$, $MgO . Al_2O_3$, $NiO . Al_2O_3$, $Sr_2O_3 . Al_2O_3$, $SrO . Al_2O_3$, $SrO . 2Al_2O_3$, $2Y_2O_3 . Al_2O_3$, $ZnO . Al_2O_3$; zirconates such as $CaO . ZrO_2$, $SrO . ZrO_2$; titanates such as $Al_2O_3 . TiO_2$, $2BaO . TiO_2$, $HfO_2 . TiO_2$, $2MgO . TiO$, $SrO . TiO_2$; chromates, such as $CaO . Cr_2O_3$, $CeO . Cr_2O_3$, $MgO . Cr_2O_3$, $FeO . Cr_2O_3$; phosphates such as $Al_2O_3 . P_2O_5$, $3BaO . P_2O_5$, $3CaO . P_2O_5$, $3SrO . P_2O_5$; and other mixed oxides, such as $La_2O_3 . Fe_2O_3$, $MgO . Fe_2O_3$, $2MgO . GeO_2$, $CaO . HfO_2$, $La_2O_3 . 2HfO_2$, $Nd_2O_3 . 2HfO_2$, 6Bao $. Nb_2O_5$, $Dy_2O_3 . Nb_2O_5$, $2MgO . SnO_2$, $BaO . ThO_2$, $SrO . UO_3$, $CaO . UO_3$, $CeO_2 . Cr_2O_3$; silicates such as $3Al_2O_3 . 2SiO_2$ (mullite), $BaO . 2SiO_2$, $BaO . Al_2O_3 2SiO_2$, $BaO . TiO_2 . SiO_2$, $2CaO . SiO_2$, $Dy_2O_3 . SiO_2$, $Er_2O_3 . SiO_2$, $ZrO_2 . SiO_2$ (zircon), $2MgO . SiO_2$, $ZrO . ZrO_2 . SiO_2$; carbides, such as titanium carbide TiC, zirconium carbide ZrC, hafnium carbide HfC, vanadium carbide VC, niobium carbide NbC, tantalum carbides TaC, $Ta_2C$, chromium carbides $Cr_3C_2$, $Cr_7C_3$, $Cr_{23}C_6$, molybdenum carbides $Mo_2C$, MoC, tungsten carbides WC, $W_2C$, thorium carbides ThC, $ThC_2$; complex carbides, such as WC + $W_2C$; ZrC + TiC, HfC; NbC, TaC, or VCl TiC + HfC, TaC, NbC, or VC; VC + NbC, TaC, or HfC; HfC + TaC or NbC; HbC + TaC; WC + TaC, NbC, ZrC, TiC; WC + TiC or ZrC; TiC + $Cr_3C_2$; TiC + $Mo_2C$;

Borides, such as $TiB_2$, $ZrB_2$, HfB or $HfB_2$, borides of V, borides of Nb, borides of Ta, borides of Cr, borides of Mo, borides of W, borides of the rare earth metals;

Silicides, such as silicides of Ti, e.g. $Ti_5Si_3$
Silicides of Zr, e.g. $Zr_6Sr_5$
Silicides of Hf, e.g. $Hf_5Si_3$
Silicides of V, e.g. $V_3Si$ or $VSi_2$
Silicides of Nb, e.g. $Nb_5Sr_3$ or $NbSi_2$
Silicides of TA, e.g. $Ta_5Si$ or $TaSi_2$
Silicides of Mo, e.g. $MoSi_2$
Silicides of W, e.g. $WSi_2$
Silicides of Cr, e.g. $Cr_3Si$ or $Cr_3Si_2$
Silicides of B, e.g. $B_4Si$ or $B_6Si$
Silicides of the rare earth metals;
Nitrides such as boron nitrides and silicon nitrides Sulfides such as MgS, BaS, GrS, TiS, ZrS, $ZrS_2$, HfS, VS, $V_2S_3$, CrS, $MoS_2$, $WS_2$, the various rare earth sulfides;

Metalloid elements such as boron, silicon, germanium;

Cermets, such as WC/Co, $W_2C$/Co, WC + $W_2C$/Co, Cr/$Al_2O_3$, $Ni_{2/3}Al_2O_3$, NiAl/$Al_2O_3$, NiAl/-$ZrO_2$, Co/$ZrO_2$, Cr/$Cr_3C_{22}O_3$, Co/TiC, Ni/TiC, Co/WC + TiC, TiC/NiCr, Cr + Mo/$Al_2O_3$, Ni, Fe and/or their alloys, Cu and/or its alloys such as aluminum bronze, phosphor bronze, ets., with the disulfides or diselenides of Mo, W, Nb, Ta, Ti, or V, or boron nitride for self-lubricating coatings with very low friction coefficient;

Cermets which contain an active metal from the group composed of Ti, Zr, Ta, Cr, etc., or hydrides or other compounds or alloys of these active metals, which will alloy with the metal phase of the cermet and promote adhesion of the metal phase to the refractory phase by promoting wetting of the surface of the refractory phase;

Cermets, for instance those containing a metal and a carbide as the refractory phase, which also contain free carbon, such as high purity graphite or the like, which will effectively reduce or prevent oxidation of the carbide phase and reduce solutioning of the carbide phase in the metal binder phase;

Combinations which when flame sprayed, will exothermically react such as nickel and aluminum or other combinations of U.S. Pat. No. 3,322,515 or which endothermically react, or combinations or components which will decompose to form desired coating materials, as for example carbonates, oxalates, nitrates or oxychlorides which will decompose to form oxide coatings, as for instance those of thorium, zirconium, magnesium or yttrium may be used. Furthermore, mixtures of oxides and metals which react in a redox-type of reaction, converting a metal to an oxide and an oxide to a metal, forming metal-oxide mixtures into metal-oxide or intermetallic-oxide or cermets or the like, as for instance $$3NiO + 2Al \rightarrow 3Ni + Al_2O_3 \text{ or}$$

$$3NiO + 5Al \rightarrow 3NiAl + Al_2O_3$$

$$Cr_2O_3 + 2Al \rightarrow 2Cr + Al_2O_3 \text{ or}$$

$$Cr_2O_3 + 4Al \rightarrow 2CrAl + Al_2O_3$$

$$Fe_2O_3 + Al \rightarrow 2Fe + Al_2O_3$$

Mixtures of metal oxides and reducing agents, metals and nonmetals, such as boron, silicon, nitrogen, sulfur, phosphorous or the like;

Metal hydrides alone or in mixture with other materials, such as metal oxides, and the like.

It is possible to use as the mixtures agglomerates of different minerals since this ensures that the sub-components will still be adjacent one another during spraying, i.e. the particles released from the wire will still be agglomerates. Such agglomerates may be held together by comparatively highmelting or decomposing plastics which have a higher decomposition temperature than the polyurethane, epoxy or acrylic binder, e.g. phenol-formaldehyde. Thus flame spraying will decompose the wire binder but not the agglomerate binder. Agglomerates may also be prepared by spray drying and/or sintering, with or without binders.

The mineral powders whether single materials, mixtures and/or agglomerates are desirably no more than about 140 mesh in size. Larger particles result in a poorer quality of coating and may even result in interruption of the spraying operation. Advantageously, the mineral powder particles are no more than about 325 mesh but are at least about 1 $\mu$, smaller particles being too fine to be properly propelled to the substrate.

When these mineral powders are to be coated with a silicone resin prior to combination with the wire binder, there may be employed silanes and/or siloxanes. The organic radicals may be optionally substituted aliphatic or aromatic such as alkyls, e.g. methyl, ethyl, butyl, cyclohexyl, and the like, alkenyls such as vinyl or allyl, aromatics such as phenyl, etc. Suitable materials are described in Union Carbide's Silane Adhesion Promoters in Mineral-filled Composites No. F 43598, (1973) and "Adhesion Promoters" No. f 42324, Dow Corning's "Silane Coupling Agents" Form No. 23-012 and "Silane Coupling Agents" Form No. 03-028. An especially satisfactory class comprises Dow Corning's Z 6020, an aminofunctional silane and/or Z 6050 polyaminofunctional silane.

The surface active resins are applied to provide a layer of up to about 15 molecular thicknesses, preferably up to about 5 molecular thicknesses. Greater thicknesses do not improve the effect, add to the cost and sometimes even diminish the quality of the product. Advantageously, there is at least one full layer thickness and about 1 to 5 thicknesses to ensure the desired effect and to allow for the fact that the resin may not be absolutely uniform in thickness throughout.

The resin may be applied to the mineral powders in molten form although preferably it is applied as a solution or an emulsion in a solvent such as water or an organic solvent. Contact is effected in conventional manner, excess liquid is evaporated off and the powder is allowed to dry, preferably with agitation to prevent clumping and to promote uniform thickness of the coating as it dries. The amount of silicone resin based on the weight of the powder will, of course, depend upon the powder particle surface area, the molecular constitution of the resin and on the average thickness of the resin layer; generally it will range from about $0.5 \times 10^{-4}$ gm/meter$^2$ to $75 \times 10^{-4}$ gm/meter$^2$, and preferably from about $2.5 \times 10^{-4}$ gm/meter$^2$ to $25 \times 10^{-4}$ gm/meter$^2$ of surface area of the flame spray powder as determined by the BET method.

Polyurethane polymers which can be employed in the practice of the invention include any of those thermoplastics well known in the art made by reacting polyisocyanates such as toluylene diisocyanate or preferably methylene-diphenyl isocyanate with polyfunctional structures such as polyglycols, e.g. polyethylene glycol, polyesters, e.g. polyethylene adipate, polyether esters, and the like. Representative polyurethanes are described in U.S. Pats. Nos. 2,968,575, 3,148,173, 3,281,297, 3,294,724, 3,410,817 and in Dietrich et al, Angewandte Chemie, Vol. 82 (1970), No. 2 pages 53–63, the disclosures of which are incorporated herein by reference. Polyether based polyurethanes are preferred.

The curing agent or hardener, which is mixed with the polymer in proportion such as 3.3 to 1 (resin to hardener), serves both to lengthen the molecular chains, and to cross link them. The extender may be any molecule with two OH radicals, for example ethylene glycol; the cross linking agent may have three OH radicals such as a trifunctional alcohol.

In addition to the foregoing patents, details of polyurethane polymers which can be employed in the practice of the present invention are set forth in Encyclopedia of Polymer Science and Technology by Mark et al Vol. 11 (1969) pages 506 ff., especially pages 548 to 554, the disclosure of which is incorporated herein by reference. Illustratively, about 45 to 70 parts by volume (pbv) of the coated powder particles of (a) are mixed with between about 55 and 30 pbv of a two-part room temperature curing urethane sold under the identification Flexane 80 by Devcon Corporation of Danvers, Massachusetts, preferably between about 48 and 65 parts by volume of coated particles of (a) are mixed with between 52 and 35 pbv of the urethane and most preferably between about 50 and 60 parts by volume of the coated powder from (a) are mixed with between about 50 and 40 pbv of the urethane, the sum total of all mixtures equalling 100 pbv. Part A (the resin) and Part B (the hardener, which when mixed together comprise the Flexane 80 urethane) are mixed together in the proportions about 30 pbv or pbw "A" to 3 pbv or pbw "B", preferably about 8.6 pbv or pbw "A" to 3 pbv or pbw "B", and most preferably about 10 pbv or pbw "A" to 3 pbv or pbw "B", the total of parts "A" and "B" comprising the urethane mixed with the coated powder from (a).

Epoxy polymers which can be employed include condensation products of bis-phenol-A and epichlorhydrin which can be cross-linked with polyfunctional agents such as di-carboxylic acids or anhydrides, diamines, or the like. Representative epoxy resins are described in Encyclopedia of Polymer Science and Technology by Mark et al Vol. 6 (1967) pages 213 to 219 and cross-linking curing agents are described at pages 222 to 238, the disclosures of which are incorporated herein by reference.

Acrylic polymers include homo- and co-polymers of acrylic and/or methacrylic acids, esters and nitriles. Representative materials and curing agents therefor are described in Encylopedia of Polymer Science and Technology by Mark et al Vol. 1 (1964) pages 226–241, especially pages 229–233, the disclosure of which is incorporated herein by reference.

As noted, where the resin/hardener mixture and inorganic powder are first sheeted and partially cured so that upon subsequent crumbling and extrusion through a plastic wire extruding machine, the composition and proportions of resin and curing agent and/or the thermal treatment of the sheeted viscous mass are so interrelated to effect only a partial cure in such sheet form. Thus the material will soften but not decompose in the barrel of the screw extruder. The preferred conditions for any particular composition can readily be determined by simple experiments.

Especially useful polymers include the polyurethane sold by Devcon Corporation under the trademark Flexane, especially Flexane 80, in which the resin has a viscosity of at least 35,000 centipoise at 70° F. A suitable epoxy resin is Devcon LR-16.

The invention will be further described in the following illustrative examples wherein all parts are by weight unless otherwise expressed. In these examples where reference is made to an abrasive wear test, the tests are conducted by cutting a disc or button from a substrate onto which the test material was sprayed, the buttons being tested as follows:

1. Measure the thickness of the test buttons (including coating) in four places, using a Supermicrometer, and record the readings. (Locate the four points for a subsequent measurement by placing marks or numbers on the periphery of the button).

2. Weigh each button accurately, using an analytical balance, and record the weight.

3. Insert a drive assembly in a drill press spindle.

4. Place a platform scale on the drill press table. Pull the drill press arm (handle) down to a horizontal position and lock it in place.

5. Raise the drill press table until the drive assembly indicates a 11.25 kg load on the scale platform.

6. Unlock the drill press spindle. Hang a weight on the press arm, located so as to indicate a 11.25 kg reading on the scale. Mark the point on the arm where this reading is obtained.

7. Remove the scale.

8. Raise the spindle and replace the aligning pin with a 3.18 cm blank pin.

9. Place two test buttons on a wear track. Lower the spindle until drive pins enter the drive holes in the buttons. Lock in place, with no load on the buttons.

10. Start the drill press. Pour into pan a thoroughly mixed slurry of alumina abrasive powder (Metco 101) − 270 mesh + 15 microns in a slurry of 25 grams of abrasive in 200 cc of light machine oil. Release the lock on the spindle so that the 11.25 kg load is applied to the test buttons. Record the starting time.

11. Allow the test to run 20 minutes.

12. Remove the buttons and wash them in solvent. Weigh and measure the thicknesses and record the readings for comparison with the original readings.

EXAMPLE 1 a. A mixture is formed of 67 ½ parts by weight of molybdenum powder of nominal particle size of −30 μ + 1 μ and 32 ½ parts by weight of an alloy comprising 17% chromium, 4% iron, 4% silicon, 3.5% boron, 1% carbon, balance nickel, of −37 μ particle size. 0.37 parts by weight of a 10% by weight solution in methanol of an aminofunctional siloxane, sold by Dow Chemical Co. under the designation Z 6020 is added to the powder mixture. A further 5 parts of methanol is added so that the mass has the consistency of damp sand. The mass is stirred and heated with mild suction until all the methanol is evaporated, the mass thereafter being raised to 100° C and held there for about 2 minutes to effect full cure of the silicone resin on the powder particles. Calculating the powder surface area by the BET emthod, the particles have a silicone film averaging about 13 A in thickness, i.e. about 2.5 molecular layers.

b. 55 parts by weight of the coated powder particles of (a) are mixed with 45 parts by weight of a 3.3 to 1 volume ratio of a polyether base polyurethane resin-hardener mixture sold by Devcon Corp. under the designation Flexane 80, the resin having a viscosity of 45,000 centipoise at 20° C. The mix, in the form of a slab or small lumps, is heated for 15 minutes at an oven temperature of 80° C effecting partial cure of the urethane. The resultant material is then granulated until it will pass through a 4 mesh screen.

(c) The granules produced in (b) are extruded through a plastics screw extruder having a 1/8 inch die orifice to produce a continuous structure, the extruder being heated to a temperature of about 120° C and generating a pressure of about 2,300 psig. The extrudate is quenched in cold water immediately upon leaving the extruder and is immediately dried and spooled. The coiled wire or rod is flexible and can be used for high speed flame spraying at 7 lbs/hr in conventional wire spray guns without melting in the gun nozzle. The wire is sprayed in Metco Type 10 E spray gun using (1) air at 45 psig pressure and (2) acetylene at 15 psig pressure and 58 SCFH, and (3) oxygen at 37 psig pressure and 115 SCFH. The spray rate is 3.75 feet of wire per minute and the spray distance is 3½ inches. Abrasive wear test results show better wear resistance than a combustion sprayed powder coating of blended molybdenum and self-fluxing alloy (such as in U. S. Pat. No. 3,313,633), and wear resistance is comparable to a plasma sprayed blend of the powder. The excellent coating results with the wire are much easier to achieve without overheating the workpiece, than with either the powder combustion or the plasma gun.

EXAMPLE 2

Alumina powder of −25 microns size and titania powder of −10 microns are blended in the ratio 87:13 by weight. Wire is made similar to that of Example 1, except based on a 1000 gm batch of the blended powder, 15 gms of the 10% solution of surface treating agent is added to the powder followed by about 60 ml of methanol so that the mass has the consistency of damp sand. After drying, the powder surface area by the BET method indicates the particles have a silicone film averaging about 8 A in thickness, i.e. about 1.5 molecular layers. 55 parts by volume of the coated powder particles are mixed with 45 parts by volume of the same catalyzed urethane binder as Example 1. Normally there is a delay between initial spooling and use of the wire during which time the wire strength rises, i.e. after about one week at room temperature the wire has a tensile strength of about 600 psi. Wire is sprayed, giving coatings with hardnesses of Rc 55–60 and wear resistance 30% higher than a plasma flame sprayed coating of a composite powder of similar composition according to U. S. Pat. No. 3,607,343.

EXAMPLE 3

Example 2 is repeated using aluminum oxide powder in place of the alumina-titania blend, and of size −270 mesh + 15 microns. Coatings are comparable in quality to coatings sprayed with the same powder using a powder combustion gun described in U. S. Pat. No. 3,443,754, but much less skill is required because coating quality is less dependent on spray distance and on traverse rate of the gun over the substrate.

EXAMPLE 4

Wire similar to Example 3 was made except using nominally a −15 micron aluminum oxide. As sprayed surface texture is very fine, Rockwell hardness is Rc 62, and is about 50% higher than the combustion powder coating mentioned in Example 3.

EXAMPLE 5 a. Example 1 is repeated except using 60 parts by weight of the same molybdenum powder and 40 parts by weight of chromium powder of −37 microns particle size. Hardness is Rc 52 and wear resistance is about 40% higher than the coating of Example 1.

b. Example 1 is repeated using 40 parts of −325 mesh iron powder with 60 parts of the molybdenum powder, with excellent results.

c. Example 1 is repeated using −37 micron chromium powder, without any molybdenum, giving a coating with about twice the wear resistance of the coating of Example 1.

EXAMPLE 6 a. The self-fluxing alloy of Example 1 is formed into wire as there described with the catalyzed urethane binder, using different mesh sizes of the alloy. A −270 mesh powder gives wire which when sprayed at 11½ lbs/hr deposits at greater than 70% efficiency. When the coatings are brought up to about 1900° F with an oxyacetylene torch they fuse to form a nonporous coating of comparable quality and wear resistance to combustion powder sprayed and fused coatings of the same powder.

b. A −37 micron self-fluxing alloy and a −15 micron self-fluxing alloy each gives similar results, but the as-sprayed and fused surfaces are progressively smoother, requiring less material to be ground off when finishing the surfaces; continuous layers as thin as 0.001 inch may be sprayed and fused to the surface. For many applications the −37 or −15 micron powder wire is suitable even without grinding. When these coatings are fused as in Example 8, very high quality coatings are obtained, the porosity and oxide content being distinctly lower than with similar alloys sprayed and fused according to the current art, e.g. according to U.S. Pat. No. 2,875,043.

EXAMPLE 7

The wire of Example 1 is flame sprayed and the coating fused with an oxacetylene torch at a temperature of about 2000° F. The resulting coatings have twice the wear resistance of the original unfused coating. Fusing a similar coating plasma flame sprayed with a blend of self-fluxing alloy and molybdenum gives only a slight improvement in wear resistance over the unfused coating of the blend.

EXAMPLE 8

A tungsten carbide sintered aggregate containing 12% cobalt is crushed to a −33 micron powder and formed into wire in a manner similar to Example 1. Coatings sprayed at 4.3 lbs/hr give a hardness of Rc 59 and a wear resistance comparable to a plasma flame sprayed coating of a similar material. The latter is known to have about the highest wear resistance of any flame sprayed coating.

EXAMPLE 9

Chromium carbide powder sized −33 microns is blended with a similar sized nickel chromium alloy powder (80:20 alloy) using 75% chromium carbide and 25% nickel chromium alloy. Wire is produced as in Example 1 and the sprayed coating gives a wear resistance 20% higher than a plasma sprayed coating from a similar blend of powder.

EXAMPLE 10 a. Five micron copper is formed into catalyzed urethane wire. Coatings 1 mil thick, or even less, give excellent electrical and thermal conductivity, and excellent bonding to glass and other substrates.

b. Glass powder comprising silicon oxide containing smaller amounts of calcium, magnesium and aluminum oxides is crushed to −15 microns and fabricated into a wire. Sprayed coatings provide excellent electrical insulation.

EXAMPLE 11

11.8 kilograms of molybdenum powder having an approximate powder size of −30 microns plus 1 micron is placed into a mixer pot with a heater at 120° C. 54 grams of a 10% by weight solution in methanol of siloxane sold by Dow Chemical Co. as Z 6020 are mixed with 450 cc methanol and is poured into the mixer with the mixer on. The mixture is stirred and heated with a light exhaust until it is dried, for approximately 15 minutes. Basing the powder surface area on the BET method, the silicone film averages about 2.0 to 2.5 molecular layer thicknesses. 1.2 kilograms of a resin-hardener mixture is prepared, in a ratio of 3.3 to 1 by weight resin to hardener. This resin-hardener mixture is poured into the coated powder which is then mixed for about 7 minutes. The result is a crumbly mass which is placed in a tray approximately 1 inch deep and heated in an oven for about 15 minutes with the oven at 70° C. The partially cured mass is cut into 1 inch blocks which are granulated until the powder will pass through a 4 mesh screen. The granules are extruded with a plastic extruder having a 3/16 inch die orifice to produce a wire, using a temperature of about 120° C and a pressure of about 2500 psig. The wire is sprayed in a METCO type 3K wire spray gun using a 3/16 inch wire nozzle orifice, air at 35 psig pressure and 22 CFM flow, acetylene at 15 psig pressure at 66 SCFH flow and oxygen at 50 psig pressure and 156 SCFH flow. Spray rate is 9 to 10 lbs per hour and spray distance is about 3½ inches. The mild steel substrate was prepared by grit blasting with a −30 mesh aluminum oxide grit at a very low air pressure blast of 10 psig. This produced a fine surface roughness texture of around 50 micro inches aa. The bond strength of the molybdenum coating produced with the plastic bonded wire on this surface is 5,000 psi, compared with 2,000 psi using 3/16 inch solid molybdenum wire of the prior art.

EXAMPLE 12

A powder mixture similar to Example 1 is prepared except in proportion 70% by weight of molybdenum to 30% of the nickel alloy. Part of this powder mixture is surface treated using a General Electric silicone emulsion designated SM-70 catalyzed with water-soluble stannous tartrate (designated SN-236, Research Organic/Inorganic Chemical Corp.). The emulsion (which is 50% by weight as supplied) is diluted to a 0.5% by weight solution in distilled or deionized water. A 0.226% by weight solution of stannous tartrate is prepared by dissolving 0.226 gms of SN-236 in 100 gms of distilled or deionized water.

5 gms of 0.5% by weight solution of SM-70 per 100 gms of powder is added to the batch of powder (0.025 gms silicone solids per 100 gms powder). Then 1 gm of the 0.226% solution of stannous tartrate (containing 0.00226 gm solids) per 100 gms of powder, and sufficient deionized water to result in a "wet sand" consistency — about 10 gms per 100 gms powder — is added to the batch, while constantly mixing and heating the batch with a mild exhaust. After evaporation is complete the temperature of the batch is raised to 150° C and held for 4 to 7 minutes, to result in a fully cured resin film on all particle surfaces.

The batch of powder is then ready for blending with the binder resin.

The same polyurethane-hardener mix of Example 1 is prepared, and mixed with each of the treated and untreated portions of the powder to form 48% by volume of binder and 52% powder. Each mass is extruded with a ram extruder using a ⅛ inch die, 800 psig pressure at 60° C and the resulting wires are cured 8 days at room temperature.

The tensile strength of the wire made with the surface treated powder is 1123 psi. The non-treated powder wire gives 954 psi.

The wires are flame sprayed with a METCO 10E gun using 55 psig air, 40 psig oxygen, 16 psig acetylene, 4 inches spray distance and a wire feed rate of 3.75 ft/min. The surface treated powder wire sprays well, producing a good coating, with good melting of the metals and essentially no plastic inclusions. The non-treated powder wire produces unmelted metal particles and traces of plastic in the coating.

EXAMPLE 13

A thermoplastic polyurethane (TPU) designated E290 by Mobay Chemical Company, Division of Baychem Corporation, Pittsburgh, Pa. 15205, was ground to a powder of approximately −140 mesh. This TPU was blended in 15, 20, 30 and 40 volume % with 85, 80, 70 and 60 volume % (v/o) of aluminum oxide powder of about −25 micron particle size, not surface treated. Each of these blends was in turn mixed with a solvent for the TPU, i.e. dimethyl formamide; the plastic mass resulting was thoroughly mixed in a high intensity mixer, and then was extruded through a ⅛ inch diameter die at room temperature in a ram-type extruder at between 650 and 1000 psi pressure. After extrusion of the wire the solvent was evaporated, resulting in wires which, immediately after manufacture, were excellent as far as strength, flexibility and handleability were concerned except for the 15 v/o TPU plus 85 v/o aluminum oxide, which was poor in these attributes.

A length of each of the above wires was sprayed using a METCO 10E gun with air at 75 psig pressure and 24 CFM flow, acetylene at 13 psig pressure and 40 CFM flow, and oxygen at 30 psig pressure and 99CFM flow. Spray distance was 2 inches and spray rate was about 1 pound per hour based on aluminum oxide content of wire for 15 v/o TPU, or less depending on the v/o of binder used, the spray rate based on the aluminum oxide only obviously being less with those wires containing larger proportions of TPU, since the spray rate in feet per minute is the same for each of the wires. In each case, excellent coatings were deposited, but with greater difficulty in the case of the 15 v/o TPU wire because of its poorer flexibility and lower strength. After a time period of approximately 4 months in storage at room temperature other portions of the wires were retested for flexibility and handling characteristics. The TPU in the 15 v/o TPU and 20 v/o TPU wires had degraded such that the wires had embrittled, resulting in more difficulty with handleability and with sprayability. The 30 v/o TPU and 40 v/o TPU wires still retained flexibility and good handling characteristics, indicating the degradation of the TPU, presumably occasioned by intimate contact with the aluminum oxide powder particle surfaces, and their effect on the TPU was a function of time at storage temperature, and the decrease in flexibility and handleability was a function of the thickness of the TPU film between the particles of aluminum oxide in the wire, the higher v/o's of TPU resulting in thicker films between particles which had been degraded to some finite thickness, but less than the the full film thickness between aluminum oxide particles.

EXAMPLE 14

The 15 v/o TPU plus 85 v/o aluminum oxide wire described in Example 13 was manufactured except that the aluminum oxide power particle surfaces were coated with Dow Corning Company's XZ85464 primer in the manner described in Example 1.

The wire was manufactured as described in Example 13 and the result was the same except that the wire with the surface treated particles and a tensile strength about twice that of the 15 v/o TPU wire with no surface treatment on the particles and the flexibility and handleability of the wire were significantly improved.

The wire was sprayed in the same manner as described in Example 13, with the same coating results, except that because of the improved physical characteristics of this wire with the surface treated aluminum oxide particles, the sprayability and handleability were significantly improved over the 15 v/o TPU wire with no surface treatment on the aluminum oxide particles.

After the same time period — approximately 4 months — in storage at room temperature, the wire with the surface treated particles retained all of its original strength, flexibility and handleability, in contrast with the 15 v/o TPU and 20 v/o TPU wires without surface-treated aluminum oxide particles which had significantly degraded in that same period.

What is claimed is:

1. A flexible wire for use in a flame spraying process comprising a mineral powder having a particle size of less than about 140 mesh held together by about 5 to 75% by volume of the wire of a cross-linked polyurethane or epoxy polymer.

2. A wire according to claim 1, wherein said polymer does not melt, soften or decompose at temperatures below about 120° C.

3. A wire according to claim 1, wherein said polymer does not melt, soften or decompose at temperatures below about 120° C and comprises about 15 to 70% by volume of the wire.

4. A wire according to claim 1, wherein said mineral powder comprises an agglomerate of sub-particles held together by an adhesive which has a higher melting, softening or decomposing temperature than said polymer.

5. A wire according to claim 1, including a layer of a resin on the surface of said powder particles, said layer ranging from 0.1 to about 15 molecular thicknesses, said resin being different from said polymer and being surface active.

6. A wire according to claim 5, wherein said resin is a silicone and said layer ranges from about 0.5 to 5 molecular thicknesses.

7. A wire according to claim 6, wherein said polymer does not melt, soften or decompose at temperatures below about 120° C and comprises about 15 to 70% by volume of the wire.

8. A wire according to claim 7, wherein said powder has a particle size less than about 325 mesh.

9. The process for producing a flame-sprayable flexible wire which comprises intimately mixing a mineral powder having a particle size of less than about 140 mesh with a polyurethane or epoxy polymer present in about 5 to 75% by volume of the mixture and a curing agent for converting said polymer to a thermoset resin, and subsequently extruding said mixture under heat and pressure to produce an already cured cross-linked flexible wire.

10. The process of claim 9, wherein said powder particles prior to mixing are provided with a layer of a resin ranging from 0.1 to about 15 molecular thicknesses, said layer being different from said polymer, being surface active and protecting said polymer against any catalytic action thereon of said material.

11. The process of claim 9, wherein said mixture is heated to cure said polymer and form a crumbly structure, said structure is crumbled to a coarse powder comprising a multiplicity of original powder particles bonded together by said polymer, and said coarse powder is subjected to said extrusion.

12. The process of claim 9, wherein said powder particles prior to mixing are provided with a layer of a silicone resin ranging from about 0.5 to 5 molecular thicknesses, said polymer comprises about 15 to 70% of the total volume of the mixture, and the thermoset resin which is produced does not melt, soften or decompose at temperatures below about 120° C.

13. In the process for producing a flame-sprayable flexible wire by intimately mixing mineral powder particles with a polymeric organic binder subject to eventual catalytic attack by said mineral powder particles, and extruding said mixture to produce said wire, the improvement which comprises mixing said mineral powder particles with a silicone resin in sufficient amount to form a silicone layer and said particles ranging from 0.1 to about 15 molecular thicknesses prior to mixing said particles with said binder, whereby said binder is protected against any catalytic action thereon of said mineral.

14. In the process for extruding a plastic wire wherein a plastic composition comprising a polyurethane or epoxy resin filled with inorganic powder is extruded through a heated extruder to form a flexible substantially thermoset wire, the improvement which comprises first partially curing the plastic composition outside said extruder, and extruding said partially cured composition.

15. The process according to claim 14, wherein said plastic composition is first partially cured in the form of a sheet which is crumbled to coarse granules which are supplied to said extruder.

16. In a flame spraying process for coating a surface, the improvement which comprises flame spraying said surface with a flexible wire according to claim 1.

17. The process according to claim 16, wherein said powder has a particle size less than about 325 mesh, the powder particles carry on their surfaces a layer ranging from about 0.5 to 5 molecular thicknesses of a silicone resin, and said polymer is a cross-linked polyurethane or epoxy resin, does not melt, soften or decompose at temperatures below about 120° C and comprises about 15 to 70% by volume of the wire.

18. A coated article produced by the process of claim 17.

19. A wire according to claim 1, wherein said mineral powder comprises copper.

20. A wire according to claim 19, wherein said polymer is a cross-linked polyurethane resin.

21. A wire according to claim 8, wherein said mineral powder comprises copper and said polymer is a cross-linked polyurethane resin.

22. A wire according to claim 21, wherein the copper has a particle size of the order of magnitude of 5 microns.

23. The process according to claim 17, wherein said mineral powder comprises copper and said polymer is a cross-linked polyurethane resin.

24. The process according to claim 17, wherein the copper has a particle size of the order of magnitude of 5 microns.

25. A coated article produced by the process of claim 23.

26. A coated article produced by the process of claim 24.

* * * * *